US005207424A

United States Patent [19]

Bleam et al.

[11] Patent Number: 5,207,424

[45] Date of Patent: May 4, 1993

[54] CASTING GAME

[75] Inventors: Richard J. Bleam; Rene Wade, both of Springfield, Mo.

[73] Assignee: Bass Pro Shops, Inc., Springfield, Mo.

[21] Appl. No.: 897,833

[22] Filed: Jun. 12, 1992

[51] Int. Cl.[5] ..... A63F 9/00

[52] U.S. Cl. ..... 273/140

[58] Field of Search ..... 273/140, 330

[56] References Cited

U.S. PATENT DOCUMENTS

| | | | |
|---|---|---|---|
| 550,476 | 11/1895 | Braaf | 273/140 |
| 626,995 | 6/1899 | Haigh | 273/140 |
| 1,640,259 | 8/1927 | Vallat | 273/140 |
| 1,910,863 | 5/1933 | Sullivan | 273/140 |
| 2,408,141 | 9/1946 | Heil | 273/140 X |
| 3,106,394 | 10/1963 | Gelbart | 273/140 X |
| 4,165,075 | 8/1979 | Popovich | 273/140 |

*Primary Examiner*—William H. Grieb

*Attorney, Agent, or Firm*—Kokjer, Kircher, Bowman & Johnson

[57] ABSTRACT

A casting game which tests the skills of fisherman. A platform is provided upon which the contestant may stand and cast a plug. A pool of water surrounds at least a portion of this platform, with the pool divided radially into a plurality of lanes or segments. Located within the segments are numerous targets which take the form of cylinders having open upper ends. The contestant attempts to place the plug or piece of tackle within these cylinders by casting the plug using a standard fishing rod. The various lanes of the pool may be designated for use with a particular type of rod, plug or casting motion. The contestant who hits the most number of targets within a specified time period is the winner. In a preferred embodiment the upwardly open cylinders forming the targets will have associated lights, such that they are illuminated after the plug has entered the target, providing an indication that such particular target has already been struck. To increase spectator attraction, a large display board may be provided, which includes a representation of the pool and the various lanes and targets, with the targets on the board being illuminated as with the actual targets within the pool. To increase the realism of the game, the platform upon which the contestant stands may comprise an actual boat typically used for fishing.

15 Claims, 2 Drawing Sheets

CASTING GAME

BACKGROUND OF THE INVENTION

Field of the Invention

The present invention relates in general to games of skill. In particular, the present invention relates to a game which tests the casting skill of a fisherman.

Description of the Related Art

Fishing, in its various forms, has been a popular pastime, and in recent years it has become a popular competitive sport. In most fishing tournaments the contestants are judged based upon the number, weight, size, or some calculation using these figures, of the fish which they can catch within a particular time period. While various skills, and luck, are involved, the skill of casting the fishing lure to the desired location is one of the more difficult and important skills.

SUMMARY OF THE INVENTION

An object of the present invention is to provide a game which will test and develop the casting skills of fisherman.

Another object of the present invention is to provide such a game which is interesting and exciting, such that it may be enjoyed by spectators.

These and other objects are achieved by a casting game which tests the skills of fisherman. A platform is provided upon which the contestant may stand and cast a plug. A pool of water surrounds at least a portion of this platform, with the pool divided radially into a plurality of lanes or segments. Located within the segments are numerous targets which take the form of cylinders having open upper ends. The contestant attempts to place the plug or piece of tackle within these cylinders by casting the plug using a standard fishing rod. The various lanes of the pool may be designated for use with a particular type of rod, plug or casting motion. The contestant who hits the most number of targets within a specified time period is the winner. In a preferred embodiment the upwardly open cylinders forming the targets will have associated lights, such that they are illuminated after the plug has entered the target, providing an indication that such particular target has already been struck. To increase spectator attraction, a large display board may be provided, which includes a representation of the pool and the various lanes and targets, with the targets on the board being illuminated as with the actual targets within the pool. To increase the realism of the game, the platform upon which the contestant stands may comprise an actual boat typically used for fishing.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
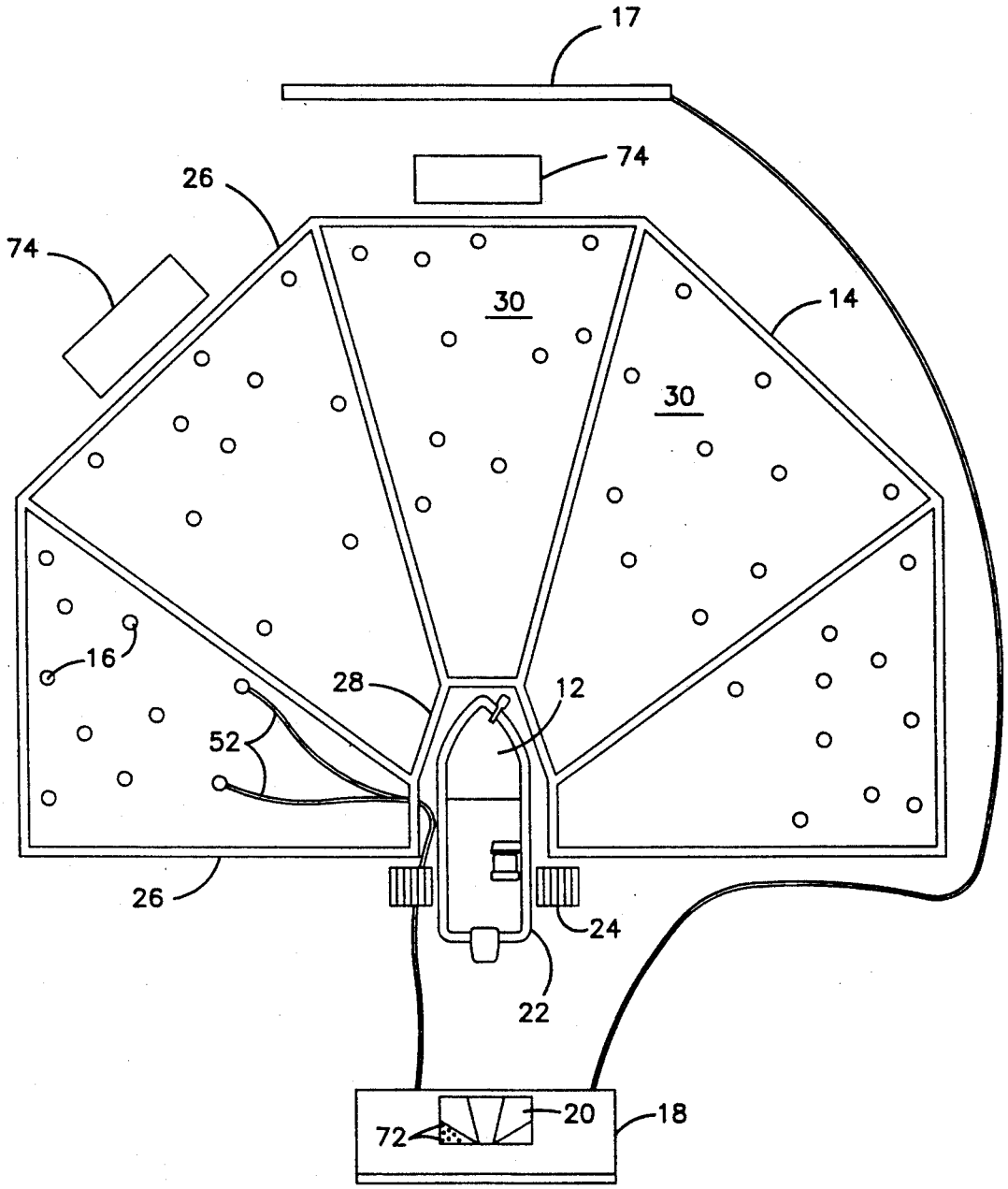
FIG. 1 is a plan view showing an arrangement for practicing the game according to the present invention.

With reference to FIG. 1, an apparatus to practice the present game is generally indicated by reference numeral 10. This apparatus generally consists of a casting platform 12, and pool 14, and plurality of targets 16 and a display board 17. In certain embodiments the apparatus 10 may additionally include a judges' stand 18 with control board 20.

The casting platform 12 is intended to support the contestant during the play of the present game, and preferably provides a stable support clear of obstructions. As the present game is concerned with a skill involved in sport fishing, it is preferred that the platform 12 be formed by a standard portion of a deck of an actual boat 22, preferably of the type typically use for sport fishing. The boat 22 may be placed upon a support having rollers or casters, as is typically known for the display of boats in showrooms, to provide stability to the boat without causing damage thereto. The use of an actual boat 22 not only provides realism to the game, but opens the possibility for commercial sponsorship or endorsement of the game, such that prize money may be awarded. Towards this end the boat 22 may include various accessories such as a motor, trolling motor, etc. to increase the various commercial sponsors. Access to the platform 12 on boat 22 is provided by one or more sets of stairs 24.

The platform 12 is located adjacent the pool 14. While the pool may take various configurations, due to the nature of the game it is preferred that the pool have roughly semi-circular shape with the platform 12 located adjacent the center of such circle. This is due to the fact that the contestant will stand upon the platform and cast outwardly. As such, the longest anticipated accurate cast may form the radius for such semi-circular shape, with this radius sweeping through some specified angle to define the semi-circular shape.

This generally semi-circular shape may of course be modified for ease of construction. For example, in the present arrangement the pool 14 includes outer sidewalls 26 which extend laterally away from the platform 12 and include five sides forming a shape roughly similar to one half of an octagon. While not strictly necessary, the pool shown in FIG. 1 additionally includes inner sidewalls 28 which extend into the semi-circular shape of the pool such that the platform 12 is substantially surrounded by the pool 14. This arrangement provides an improved position for the contestant to play the present game.

The pool 14 may be formed as a single large pool, but it is preferred that it is divided into a plurality of lanes or segments 30. For example, a generally radial line extends from the apexes of each of the five sides in the outer sidewalls 26 towards the platform 12 and meets the inner sidewalls 28 to define five discreet lanes 30. As will become apparent from the discussion of the play of the game below, the formation of plural lanes increases the difficulty and interest level of the present game.

Figure 2:
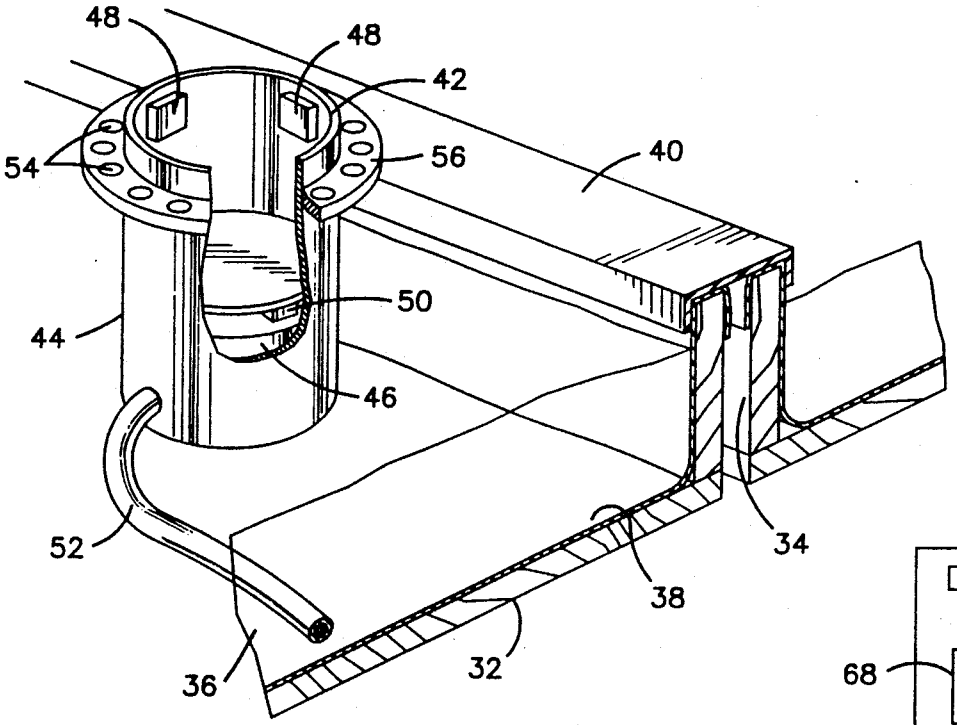
FIG. 2 is a perspective view in partial cross section along line 2—2 of FIG. 1.
Figure 3:
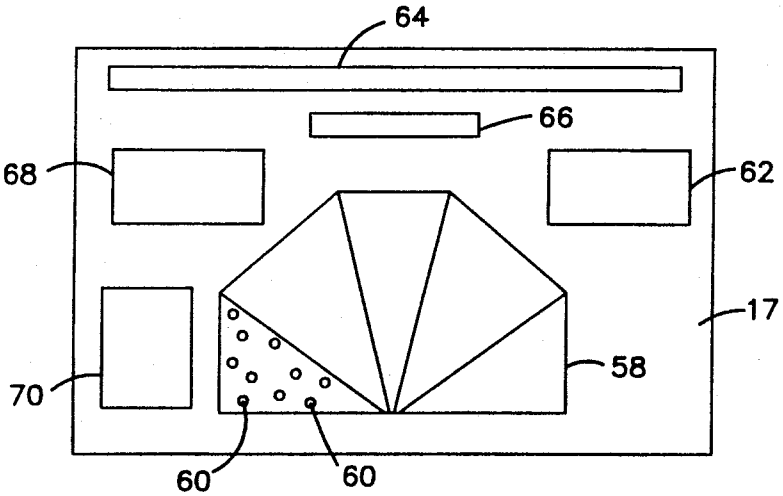
FIGS. 3 is a front view showing the various segments of a display board employed with the game according to the present invention.

As is best shown in FIG. 2, each of the lanes may be formed of a wooden or metal frame having a bottom 32 and peripheral sidewalls 34. This frame should be sufficiently strong to support a body of water received within the lane. While the bottom and sidewalls could act alone as a reservoir to receive the water 36, it is difficult to maintain watertight integrity. A simple solution to this problem is to locate a liner 38 within each of the lanes 30, with the liner providing a water tight surface. The liner 38 may advantageously be formed of a standard material typically used to form covers employed for swimming pools, with the excess material being folded over the sidewalls 34 to be placed out of view and improve the aesthetics. In addition to providing a simple and inexpensive means of maintaining the lanes in a water tight configuration, these pool covers are typically formed in a light shade of blue which imparts a clean and clear look to the water 36 to improve the enjoyment of the present game.

While the use of such a blue colored liner improves the overall appearance, the use of identical liners for each of the lanes 30 may make it difficult to differentiate the various lanes, which may be an important part of the present game. To assist in this the upper ends of the adjacent sidewalls 34 may be covered with a sheath 40. The sheath 40 may advantageously be formed of a flat piece of plastic or weatherproof carpet, or a piece of plastic having a generally C shaped configuration opening downward, such that it slightly encompasses the upper ends of the adjacent sidewalls 34. To provide the contrast and thus clearly delimit each lane, the sheath 40 is preferably formed of a material having a color readily differentiated from the color of the liner 38. For example, the sheath 40 may be formed of a material which is a darker shade of blue than the liner 38. This arrangement will provide a clear indication of the limits of each lane, while still providing an overall impression of a single body of water. To further improve the aesthetics, the sheath 40 may also be located above the outer sidewall 26 and inner sidewalls 28, for consistency.

As noted above, a plurality of targets 16 are located within the pool 14, and in particular it is preferred that a plurality of the targets are located within each of the lanes 30.

With reference to FIG. 2, the targets 16 each include an upwardly extending opening 42 which will receive the plug or tackle cast by the contestant. Additionally, it is preferred that the targets 16 rest upon the bottom of the lanes 30 (i.e. do not float) such that they are in a fixed position for all contestants in a particular game to facilitate a fair contest. To achieve these ends it is preferred that the targets 16 each be formed as an upwardly opening cylinder 44. The cylinder may be formed of metal or plastic, although where the cylinder is formed of plastic it may be necessary to provide weights 46 in the bottom of the cylinder to overcome its buoyancy.

It is preferred that the targets 16 be located such that only one target is placed long any radial line extending from the casting platform 12. This is because the plug will travel upon the surface of the water as the player reels the line in after each cast. Where two targets are located along the same radial line, the plug is likely to strike the radially inner target 16, possibly slowing the progress of the player.

The targets may include means for detecting the entry of the plug into the cavity of the cylinder. Such means may include one or more proximity detectors 48, and/or a scale 50 for detecting weight variations. The use of the scale 50 may not be sufficient in and of itself as the water 36 may occasionally splash into the cavity of the cylinder 44, causing an indication of weight change without the presence of a plug. As such, the detectors 48 are believed to be more reliable, and it is possible to provide a appropriate circuitry that the scale 50 and detectors 48 must both provide a detection signal within a specified period of time before a hit is indicated. The detectors 48 and scale 50 may be operatively connected with additional equipment, described below, by means of electrical cable 52.

It is preferred that the targets 16 are provided with means to indicate that a plug has entered its cavity, and that the target has thus been hit. While various means could be employed, it is preferred that this means takes the form of a plurality of lights 54 which are illuminated upon entry of the plug into the cavity of the appropriate cylinder 44. The lights 54 may be arranged about the entire periphery of the cylinder, near the opening 42, and maybe advantageously mounted upon an outwardly extending rim 56. The electrical cable 52 may additionally provide power for the lights 54 during play of the present game.

To contribute to the realism of the game it is preferred that the cylinders 44 have height such that the opening 42 is located near the upper level of water 36 within the lanes 30. Additionally, it is preferred that the lights 54, and thus the rim 56 also be located above the water surface to improve visibility. The depth of the water 36 within the lanes 30 may be quit deep if desired, but need only be sufficiently deep such that the plug or tackle may pass through the water without snagging the cables 52 when the user reels up the line to prepare for another cast. As such, in a preferred embodiment the sidewalls 34 may be approximately one foot tall, with the water level being one to three inches below the upper end of the sidewalls.

While the lights 54 will clearly indicate the targets 16 when lit (after being hit), the target 16 should be clearly visible to the contestant to aide in casting. In particular, the opening 42 of the cylinders should be highly visible. Along these lines it is preferred that the exterior of the cylinders 44 be painted a color closely matching that of the liner 38, such that the cylinders per se are not highly visible. However, the interior of the cavity, readily viewed through the opening 42, should be colored to highly contrast with this liner. For example, the interior of the cylinders may be painted a bright orange.

To increase spectator enjoyment of the present game, it is preferred that the various cables 52 from the targets 16 be operatively connected to the display board 17. The display board will be located at a position readily viewed at least by the spectators, and preferably by the spectators and contestant. The display board will have a sufficient size such that the information displayed thereon may be readily viewed, and illumination may be employed to increase visibility.

The display board includes various segments for display of information, including a lane representation 58. The element 58 will have a shape generally corresponding to the pool 14, and preferably will include a plurality of target indicators 60 within each of the lanes represented. As with the targets 16, the target indicators 60 may be formed with lights such that they may be illuminated upon the contestant scoring a hit. One or more indicators will be lit which have a position at least roughly corresponding with the actual location of the target hit. With this arrangement the lane representation 58 will become increasingly filled with illuminated indicators 60 as the contestant successively achieves hits, providing the spectators with a clear view of the progress of the game.

The second major element for the display board 17 is a timer display area 62 which will show the elapsed time of the game, or the time remaining to play. Various other information could be provided, such as a general heading area 64 which could include the name of the game, the location of the game, or sponsorship of the particular game. A player identification field 66 could be provided to display the name of the current contestant, and a score field 68 could display a running total of the points scored by the current contestant. To enhance spectator interest, a leading score section 70 could be provided to display the names and scores of the contestants currently leading or having the highest total score.

The display board 17 may include, or be associated with, appropriate circuitry for calculating and displaying the time within timer display area 62, and may include circuitry for calculating the score for display within the score field 68 based upon signals received by the various cables 52.

An alternative or additional means for controlling the display board 17 may take the form of the control board 20, which may consist of a panel having markings corresponding to the various lanes 30 and having numerous toggle switches 72. The toggle switches 72 are preferably located at positions on the control board 20 which correspond to the location of the targets 16 within the lanes 30, such that an operator may quickly associate a toggle switch with a particular target. To allow for different distributions of the targets 16 in different games, the control board 20 may take a form similar to a peg board having various locations which may receive a lesser number of the toggle switches 72, such that the location of the switches may be varied with the varied target locations.

As a first possibility, control board 20 may control the illumination of the lights 54 on the various targets 16 and the illumination of the various sections of the display board 17. In this situation an operator or operators, acting as judges, will visually confirm that a players plug has been cast into the opening of a target 16, at which point the corresponding switch on the control board 20 will be manually activated to illuminate the target and the appropriate sections of the display board.

The control board 20 may also have appropriate switches or counters for controlling the timer display area of the display board 17, and could include keyboard means to cause the display of the players name within player identification area 66, etc. As such, in this first arrangement the determination of a hit upon a particular target is fully manual, and the detectors 48 and scale 50 need not be associated with the targets.

As a second alternative, the control board 20 may be employed as a backup to the detectors 48 and/or scale 50. For example, the control board could include circuitry such that the display board will not be illuminated to record a hit unless a signal is received from the detectors or scale in conjunction with a signal from one of the toggle switches 72 corresponding to that target. In this situation the operators acting as judges at the control board will function as a fail safe against a spurious signal from one of the targets 16.

A third example would not require the control board 20, with the signal from the target 16 being fed directly to the display board 17, as discussed above.

As a further option, the apparatus of the present game may include additional secondary casting platforms 74 associated with one or more of the lanes 30 at a position opposite that of the casting platform 12.

The various methods of playing the casting game according to the present invention will now be described.

In its most simple form, the game according to the present invention will consist of a player being located upon the casting platform 12 with a standard fishing rod having a plug at the end of the fishing line. The player will cast the plug, using the rod in a manner similar to that employed when fishing, towards the targets 16, attempting to place the plug within the cavity of the cylinder 44 forming the particular target 16. Once the plug has been placed within the target 16, that target is considered hit, and is illuminated by one of the methods described above.

A particular point value may be applied to the targets, with this point value being equal for all targets, or may be different depending upon the distance from the casting platform 12, the diameter of the target, etc. With each successive target hit, the hit targets will be illuminated, indicating that the player no longer need to attempt to hit those targets, and the total number of points scored for these hits will be totaled. After a predetermined matter of time a player will not be allowed additional casts, this signalling the end of his round. This player's total score may then be compared with that of other players to determine a winner.

The use of the multiple lanes 30 allow additional variations upon this basic theme to provide more interest for the present game. For example, a separate total score could be maintained for each of the lanes 30, with this being averaged, or the top three scores for three of the five lanes being averaged.

In a preferred embodiment, the multiple lanes are employed to further test the skill of the player, by requiring a different type of casting for various lanes. For example, one of the lanes could be restricted to use of a rod having spinning equipment and a one- quarter ounce plug. A second lane would be restricted to use of a rod having casting equipment and a one-half ounce plug. A third lane would be restricted to use of a five-ounce plug and an under handed flipping/pitching motion, rather than the typical overhead cast. The remaining lanes could be similarly designated, or could be "open" lanes where the player may use any of the above-noted types of casting. With this arrangement it is preferred that the casting platform 12 be relatively open and free of obstruction, such that the player may have numerous rods at hand, and may switch between rods quickly to accelerate the pace of the game.

As the player will be concentrating upon the targets 16 and the rod and plug, it is preferred that a horn or other audible signal be provided at the end of the time period associated with each lane. To increase crowd interaction it is also possible to encourage the crowd to provide a countdown in the final ten seconds of the time period for each lane.

In actual use of this game play arrangement it has been found that approximately ten targets 16 within each of the lanes 30, with a time limit of two to three minutes for each lane provides an exciting play of the present game.

It is also possible to play the present game in a similar fashion from the secondary platforms 74. Additionally, since a greater number of the platforms 74 may be employed (essentially equal to the number of lanes 30), it is possible to have players use the casting platforms 74 during a preliminary set of rounds, with this determining a set of finalists which will cast from the platform 12. This arrangement is useful with the apparatus according to the present invention, as these semi-final or preliminary rounds may be conducted throughout the daylight hours while the finals are conducted at night, where the illumination of the targets is most apparent and dramatic.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A casting game, comprising the steps of:

a) providing a casting platform and a pool area adjacent said platform, and a plurality of targets at spaced locations within said pool area, each of said targets having an associated score value;

b) allowing a player to cast, using a fishing rod and associated line, a plug fastened to said line into said pool area toward player-chosen ones of said targets in an attempt to contact said ones of said targets;

c) repeating step b) for a predetermined period of time;

d) summing the score values of those targets which said plug contacts as a result of said cast; and e) repeating steps b) through d) for a plurality of players, and comparing the sums of step d) to determine the player with the greatest score value sum.

2. A game as in claim 1, wherein step a) comprises said pool area consisting of a pool containing water, and said targets being non-buoyant and of a height such that said targets extend upward beyond the surface of said water.

3. A game as in claim 2, wherein step a) comprises said targets including visual indicating means which may be activated when said target is contacted.

4. A game as in claim 3, wherein said visual indicating means comprises illuminable lights.

5. A game as in claim 4, wherein step a) further comprises a control board spaced from said pool and having a plurality of manual switches, each one of said switches being operatively connected to an associated one of said visual indicating means of said targets, and wherein steps b) and c) further include causing a judge to manually activate ones of said switches corresponding to the ones of said targets which are struck.

6. A game as in claim 4, wherein step a) further comprises a display board having an area representing said pool and a plurality of target indicators therein, said target indicators being capable of illumination to indicate targets struck.

7. A game as in claim 6, wherein said providing step further comprises said display board including a timer display area capable of displaying time designations associated with said predetermined time.

8. A game as in claim 1, wherein step a) includes said pool area being divided into at least two lanes, each including a plurality of said targets, and wherein, prior to step d), steps b) and c) are repeated for each said lane.

9. A game as in claim 8, wherein step b) further comprises requiring said player to cast a particular plug type during said casting in a particular one of said lanes.

10. A game as in claim 9, wherein step a) comprises said pool area consisting of a pool containing water, and said targets being non-buoyant and of a height such that said targets extend upward beyond the surface of said water.

11. A game as in claim 10, wherein step a) comprises said targets including visual indicating means which may be activated when said target is contacted.

12. A game as in claim 11, wherein said visual indicating means comprises illuminable lights.

13. A game as in claim 12, wherein step a) further comprises a control board spaced from said pool and having a plurality of manual switches, each one of said switches being operatively connected to an associated one of said visual indicating means of said targets, and wherein steps b) and c) further include causing a judge to manually activate ones of said switches corresponding to the ones of said targets which are struck.

14. A game as in claim 12, wherein step a) further comprises a display board having an area representing said pool and a plurality of target indicators therein, said target indicators being capable of illumination to indicate targets struck.

15. A game as in claim 14, wherein said providing step further comprises said display board including a timer display area capable of displaying time designations associated with said predetermined time.

* * * * *